US006771791B2

(12) United States Patent
Shelley et al.

(10) Patent No.: US 6,771,791 B2
(45) Date of Patent: Aug. 3, 2004

(54) AIR PUMP SPEAKER

(75) Inventors: Kenneth Steven Shelley, Lake Worth, FL (US); Matthew Martin Ginther, Royal Palm Beach, FL (US)

(73) Assignee: MMATS Professional Audio, Inc., Riviera Beach, FL (US)

( * ) Notice: Subject to any disclaimer, the term of this patent is extended or adjusted under 35 U.S.C. 154(b) by 74 days.

(21) Appl. No.: 10/147,378

(22) Filed: May 15, 2002

(65) Prior Publication Data

US 2003/0215108 A1 Nov. 20, 2003

(51) Int. Cl.[7] ..... H04R 25/00
(52) U.S. Cl. ..... 381/397; 381/412
(58) Field of Search ..... 381/397, 398, 381/400, 404, 411, 412, 414, 433

(56) References Cited

U.S. PATENT DOCUMENTS 4,757,547 A 7/1988 Danley
5,042,072 A 8/1991 Button
5,081,684 A 1/1992 House
5,357,586 A 10/1994 Nordschow et al.
5,909,015 A 6/1999 Yamamoto et al.
6,219,431 B1 * 4/2001 Proni ..... 381/397

* cited by examiner

*Primary Examiner*—Suhan Ni
(74) *Attorney, Agent, or Firm*—McHale & Slavin P.A.

(57) ABSTRACT

An improved speaker having a modified front plate with air intake apertures, a vented frame, and a voice coil supported by a diaphragm constructed of gas impermeable material connected at one end to the frame and at the other end to the voice coil. Operation of the voice coil causes the diaphragm to draw air through the air intake apertures where it is drawn past the voice coil and vented out through the frame. The diaphragm operates as an air pump forcing the air past the voice coil for supplying of cool are and exhausting of heated air. A unidirectional flap may be used on the vented frame to an create air flow current past the voice coil for higher efficiency. The improved speaker provides longevity to the voice coil, the voice coil to diaphragm coupling, and to the diaphragm itself.

20 Claims, 6 Drawing Sheets

TOP VIEW

AIR PUMP SPEAKER

FIELD OF THE INVENTION

This invention relates generally to speakers and more particularly to a sub-woofer speaker having a gas impermeable suspension system that operates in conjunction with directed air flow channels for cooling of the voice coil.

BACKGROUND INFORMATION

Conventional speakers have a support frame, a voice coil, an upper suspension for support of a cone, a lower suspension system "spider" for support of a voice coil, and a motor structure that drives the voice coil. The motor structure is typically a permanent magnet mounted to a back plate of the support frame with a pole piece extending into the center of the voice coil. The voice coil has a winding of wire that converts electrical energy supplied to axially movement of the voice coil, relative to the pole piece. Movement of the voice coil creates audible sound.

A problem with high output speakers, such as sub-woofers, is that the voice coil becomes super heated during operation. The voice coil in a conventional suspension system is support by a resin treated cloth material, commonly referred to as the spider. The cloth material allows for the transfer of air through the material providing for cooling of the voice coil. The spider is attached to the voice coil by an adhesive which, over time and/or during high temperature use, becomes weak due to voice coil heat. If the adhesive is breached, sound reproduction is reduced or lost completely. The prior art attempts to provide a spider that allows heat transfer while maintaining flexibility. A problem with the conventional spider is that the attachment surface is very thin which can quickly affect adhesive life. The inner diameter of the spider forms provides the entire surface for the adhesive attachment, the surface area is typically no greater in width than the thickness of the spider.

The driver motor of a speaker is constructed of a winding of copper or aluminum wire about a former to form the voice coil. The voice coil is suspended within a magnetic field formed by the combination of a front plate, a magnet and a pole piece attached to a backplate. When an electrical current is applied to the winding, the speaker cone vibrates according to the audio frequency and polarity of the applied signal. The electrical resistance of the voice coil to current flow generates the heat and therefore increases the temperature within the speaker. This resistance to current flow represents a significant part of the driver motor's impedance, and a substantial portion of the electrical input power is converted into heat rather than into acoustic energy. In high power sub-woofer driver situations, it is common for the voice coil to reach temperatures ranging over 500° F. The ability of the speaker to tolerate heat is impacted by the attachment point of the spider where the adhesive is employed, as well as suspension excursions which place alternating stresses on the spider. The operation and performance of a speaker system is therefore inherently limited by its ability to tolerate and dissipate heat.

The use of a vented pole piece assists in the exhaust of heated air from the inner area and eliminates the audible noise typically found in non-vented pole pieces. The vented pole piece increases the thermal resistance of the sink thereby lowering the power handling capability of the speaker and is generally accepted as the preferred speaker embodiment due to the need for cooling the voice coil. Various attempts at glue enhancements have also been attempted but cannot address the numerous variables including consumer operation, speaker placement, age and UV deterioration.

A variety of designs have been employed in an attempt to address the problems associated with heat build up in speakers. Much of the design effort has been developed to creating a flow of cooling air over the voice coil itself, such as disclosed, for example, in U.S. Pat. No. 5,042,072 to Button; U.S. Pat. No. 5,081,684 to House; and U.S. Pat. No. 5,357,586 to Nordschow et al. A typical construction in speaker designs of this type involves the formation of passages in or along the voice coil which form a flow path for the transfer of cooling air from the cavity between the voice coil and the dust cap and/or diaphragm, and vent openings usually formed in the back plate of the motor structure. An air flow through these passages is created in response to movement of the diaphragm moves in one direction, air is drawn from outside of the speaker, through the vent opening in the back plate, along the passages in or along the voice coil and then into the cavity. Movement of the diaphragm in the opposite direction creates a flow out of the cavity along the reverse flow path. A problem with the approach described above is that the design and construction of the flow passages often do little more than provide venting of the area since the actual air flow generated by movement of the spider is typically relatively low volume. As a result, very little cooler ambient air from outside of the speaker actually flows along the voice coil to provide effective cooling.

U.S. Pat. No. 5,042,072 discloses an attempt at making a self-pumping action to create a flow of air through ventilating paths which, in turn, lower the temperature of the voice coil. The magnetic structure or pole piece has channels whereby cool air may be introduced and hot air may be exhausted to cool a voice coil by movement of the speaker diaphragm. The flow passages do little more than provide venting of the area or cavity between the dust cap and the voice coil. The flow generated by movement of the spider is typically relatively low volume as the spider is designed to allow air passage to assist in the cooling. As a result, very little cooler ambient air from outside of the speaker actually flows along the voice coil.

U.S. Pat. No. 4,757,547 discloses an external blower which forces air over the voice coils to cool them. However, in practice this system has drawbacks. As the gap between the voice coil and the pole piece of the magnet is very small (approximately 0.010 inches) cooling can only be achieved by forcing air through this air gap at a very high air pressure. Under a high air pressure, the dome will take on a positive set and cause the coil to be no longer centered in the gap. This offset will cause second-harmonic distortion. Additionally, the blower can be loud and obviously non-musical, resulting in speaker distortion and excessive noise.

It is a well known in the art to utilize additional components to prevent significant temperature rise in the voice coil. For example, a metallic voice-coil bobbin is often used to conduct heat way from the region of the voice coil. As another example, the voice coil is often coated with a low viscosity fluid to transfer heat produced by the voice coil into the magnetic structure from which it can more easily radiate into the surroundings. As yet another example, heat radiating fins are often mounted on the permanent magnet to improve secondary cooling.

The use of additional components to prevent significant temperature rise in the voice coil introduces numerous drawbacks. In particular, the use of additional components significantly increases the complexity of the speaker and consequently increases the overall cost of the speaker.

U.S. Pat. No. 5,357,586 to D. D. Nordschow discloses a flow-through air-cooled loudspeaker system. The loudspeaker and enclosure are provided with aerodynamically-shaped passages providing low-pressure regions for inducing flows of air into and about the driver motor of the loudspeaker in response to vibratory movement of the speaker cone. An aerodynamically-shaped body is disposed within the pole piece to define a venturi passage for exchange of air between an interior chamber defined by a coil former and the back of the speaker. Aerodynamically shaped openings are provided through the pole piece for inducing flow of air about the voice coil in the voice coil gap between the pole piece and permanent magnet. The speaker frame support is provided with aerodynamically-shaped openings to induce air flow into the interior chamber. In this manner, low-pressure regions established by the aerodynamic shapes induce flow of cooling air about the voice coil and pole piece in response to vibratory movement of the speaker.

In U.S. Pat. No. 5,909,015 to Yamamoto, there is disclosed as loudspeaker that is cooled by drawing air through a side intake aperture and exhausting the air through the center of the voice coil. However, the volume of air drawn around the voice coil and into the dusk cap and result in distortion when high energy levels are employed. Speakers which utilize venting techniques typically experience venting difficulty in drawing cooler air, and passing out warmer air since the spider is used as the ventilating pump. The conventional spider does not have the ability to pump air, while allowing the passage of air.

Thus, what is needed in the art is a means for cooling the voice coil that does not add additional components to the system but allows for a high volume of air to be pumped across the voice coil.

SUMMARY OF THE INVENTION

In general the instant invention is a high output subwoofer speaker having air intake and exhaust apertures, and a voice coil supported by a diaphragm constructed of gas impermeable material. The impermeable material, preferably rubber can be made thicker than conventional resin coated cloth spiders thereby providing a large adhesive attachment point. Operation of the voice coil causes the diaphragm to draw air through the air intake apertures where it is drawn past the voice coil and vented out through the exhaust apertures. The diaphragm operates as an air pump forcing the air past the voice coil for supplying of cool are and exhausting of heated air. A unidirectional flap may be used on the vented frame to an create air flow current past the voice coil for higher efficiency. The diaphragm allows for elongation of the suspension system with the damage found to over driven cloth suspension systems. Further, the air pump diaphragm provides longevity to the adhesive which joins the voice coil to the diaphragm by removing of heat that would otherwise compromise the adhesive.

Thus, an objective of the invention is to provide cooling of the voice coil and associated voice coil adhesive connection.

Another objective of the invention is to provide a suspension system that has a primary function to operate as an air pump for drawing air past the voice coil, and a secondary function to act as a support for the voice coil.

Still another objective of the invention is to provide enhanced cooling of the voice coil by directing a cool air intake at the voice coil as compared to allowing air to circulate in the space under the spider or dust cap.

Yet still another objective of the invention is to mount a disk between the frame and the front plate, or modify the front plate, having radial cut channels for directed placement of air around the voice coil.

Still another objective of the invention is to employ the use of a vented frame with a unidirectional aperture for exhausting of heated air.

Still another objective of the invention is to disclose a spider replacement that has a predictable and equal throw in both the positive and negative excursions.

An advantage of the instant invention is to provide a suspension system that can handle higher positive and negative excursions without damage.

Another advantage of the presented suspension system is the enhanced surface area made possible between the voice coil and the diaphragm allowing for greater adhesive attachment.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

Figure 1:
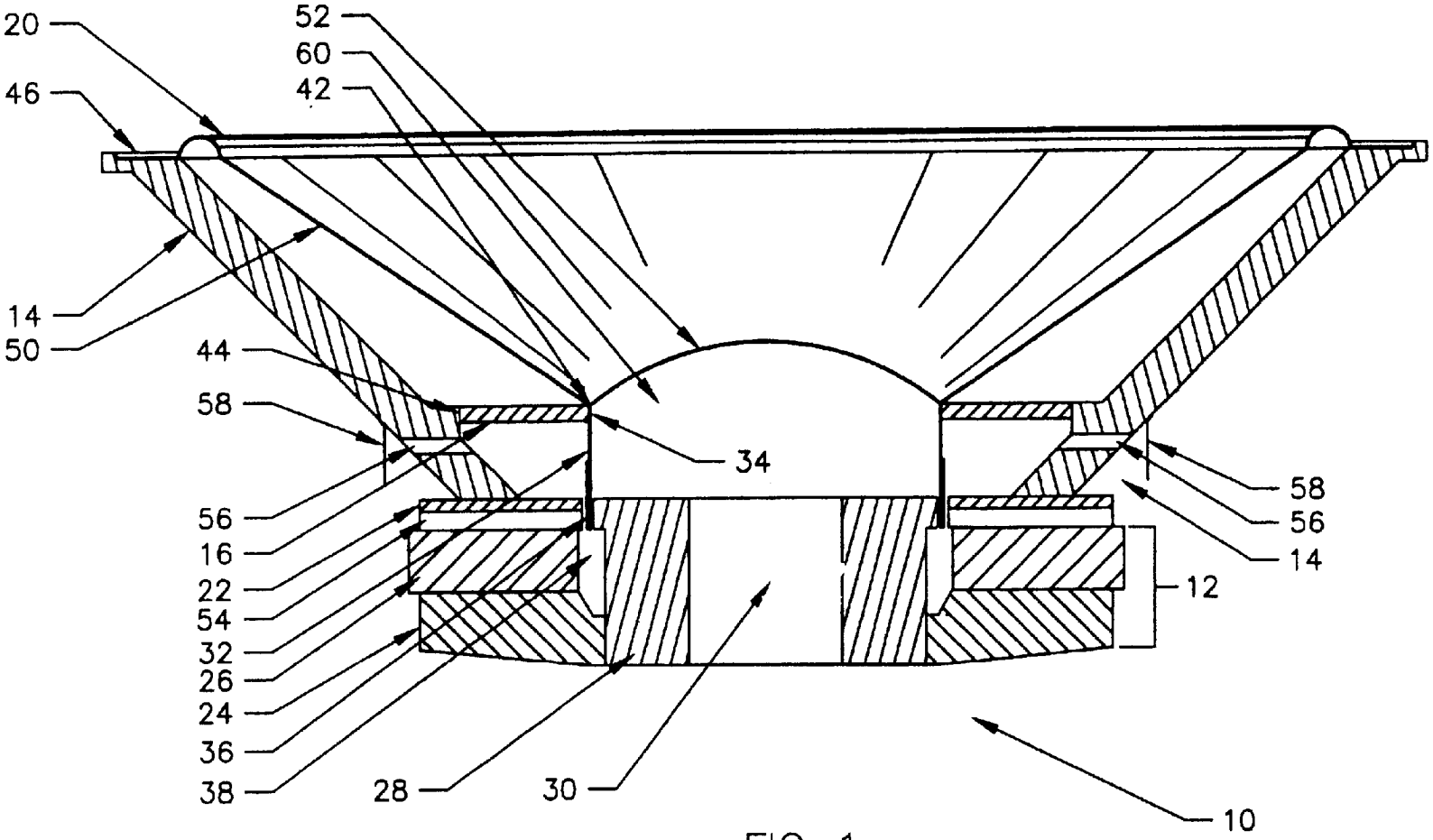
FIG. 1 is a cross sectional side view of the preferred embodiment of the instant invention.

Now referring to FIG. 1, set forth is a speaker 10 having a motor structure 12, a frame 14 mounted to the motor structure, a lower suspension 16, a cone 18, and an upper suspension or surround 20. The motor structure 12 includes a front plate 22 and a back plate 24 which are spaced from one another by a permanent magnet 26. A pole piece 28 is connected to and extends upwardly from the back plate 24 into a central bore 30 formed in both the magnet 26 and front plate 22. The pole piece 28 may be formed with a central bore or it may be solid. A voice coil 32 formed from a hollow, cylindrical-shaped former 34, having an inner surface and an outer surface which receives a wire winding 36. The former 34 is concentrically disposed about the pole piece 28, and the voice coil 32 is axially movable within a magnetic gap 38 formed between the magnet 26 and the pole piece 28.

The voice coil 32 is held in place with respect to the pole piece 28 by the diaphragm 16 and surround 20. The lower end 42 of the diaphragm 16 is affixed to the former 34 of the voice coil 32 by adhesive, and its opposite upper end 44 connects to the frame 14 also by crimp or adhesive. The surround 20, in turn, is mounted to the upper end 46 of the frame 14 wherein the diaphragm 16 and surround 20 collectively provide support for the voice coil 32 and cone 50. A dust cap 52 covers upper portion of the motor structure. The dust cap 52 overlies the voice coil 32 and pole piece 28 in order to protect such elements from dirt, dust and other contaminants. In response to the input of electrical energy to the wire winding 36, the voice coil 32 is moved axially with respect to the fixed motor structure 12. Because the diaphragm 40, surround 20 and dust cap 52 are operatively connected to the former 34, such elements also move with the excursion of the voice coil 32. A "pumping" action is created as a result of axial movement of the diaphragm 16 which creates a flow of air into and out of the cavity 48.

In the preferred embodiment, the front plate 22 is a non-ferrous disk having radial cut channels 52 for directing air towards the voice coil. Within the frame 14 are vents 56 which are used to exhaust the heated air away from the voice coil 32. A unidirectional seal or flap 58 prevents air from being pulled though the vent hole. It should be noted that on smaller speakers that do not draw excessive amount of power thereby causing excessive heat, the vent 56 may be sufficient for air circulation without the need for a lower intake. However, on high capacity speakers, such subwoofers that are found in SPL contests, the voice coils exceed 3 inches in diameter and are operated by magnets exceeding 250 ounces. In such instances the suspension system (spider) is subjected to extreme excursions and the heat along the voice coil may exceed 500 degrees F. when operating at output powers exceeding 1000 watts. The super high capacity speakers, operating at 3000 watts have a tremendous and instantaneous build up of heat that can be successfully treated by creating an air pump current.

Figure 2:
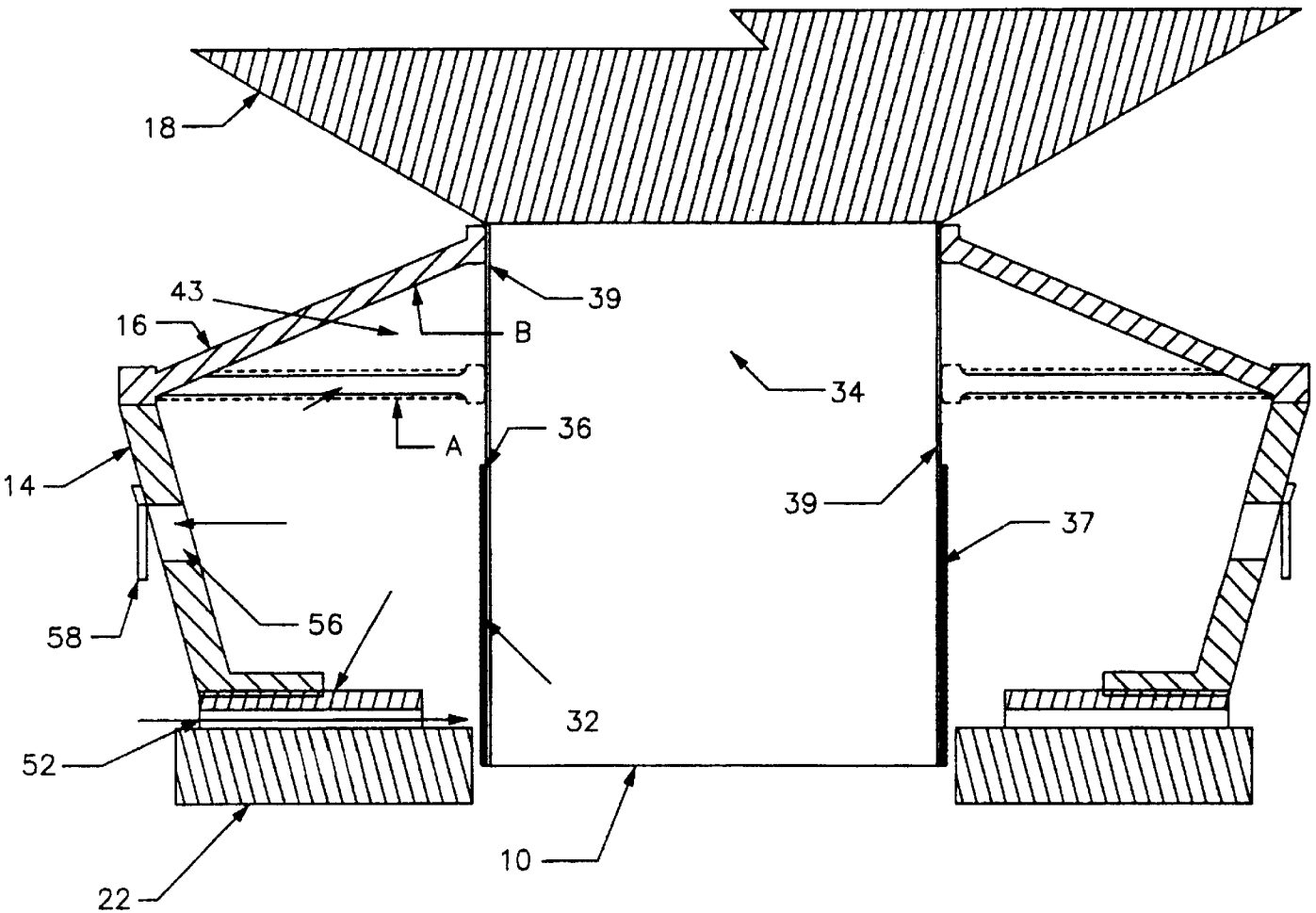
FIG. 2 is a cross sectional pictorial view depicting a positive excursion.

Now referring to FIG. 2, set forth is a partial pictorial of the speaker 10 depicting the frame 14, suspension 16, cone 18, and front plate 22. The voice coil 32 is shown formed from a hollow, cylindrical-shaped former 34 having an inner surface 35 and an outer surface 37 which receives a wire winding 36. The voice coil 32 is held in place by the diaphragm 16 which is affixed to the former 34 by adhesive 39. The diaphragm is preferably formed of butyl rubber or neoprene having a durometer of about 30 Shore A about ¼ inch thick. Shown in the pictorial is the neutral position A of the diaphragm 16 and the positive excursion position B, with the associated volume increase 43. The front plate 22 is a non-ferrous disk having radial cut channels 52 for directing air towards the voice coil 32. During the pump, air is drawn through the cut channels 52 and directed along the wire winding 36 of the voice coil 32. Within the frame 14 are vents 56 which are used to exhaust the heated air away from the voice coil 32 when the voice coil 32 is placed in a negative excursion, shown in a later drawing. A unidirectional flap 58 prevents air from being pulled though the vent 56 and the aperture sizing of the cut channels 52 also inhibits flow back through the channel.

Figure 3:
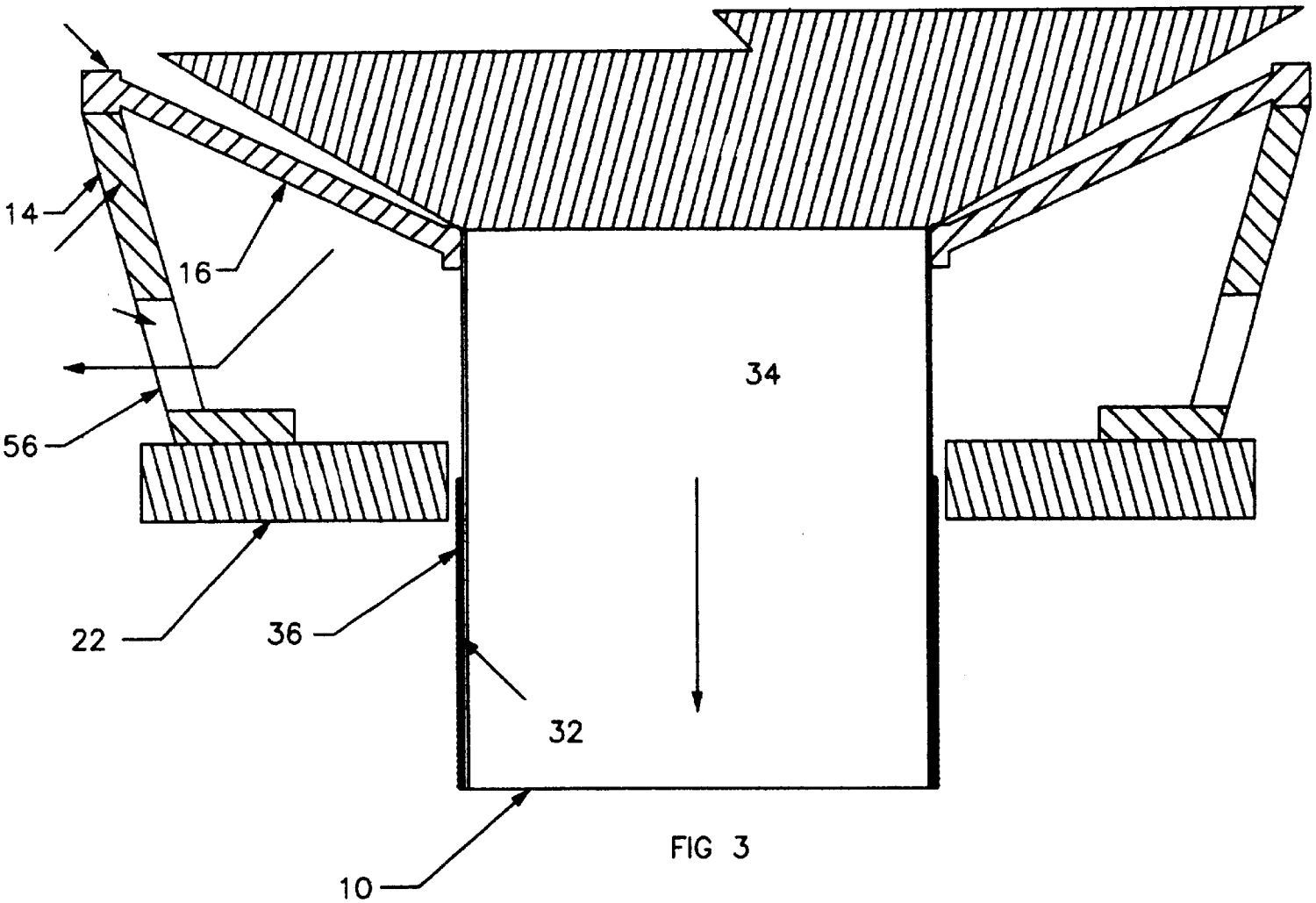
FIG. 3 is a cross sectional pictorial view depicting a negative excursion.

FIG. 3 depicts the speaker 10 in a negative excursion wherein the heat pulled from the voice coil is exhausted through the vent 56. The rubber diaphragm 16 is shown in the negative excursion position and further illustrates the range of motion expected due to an unusual excursion during high output operation.

Figure 4:
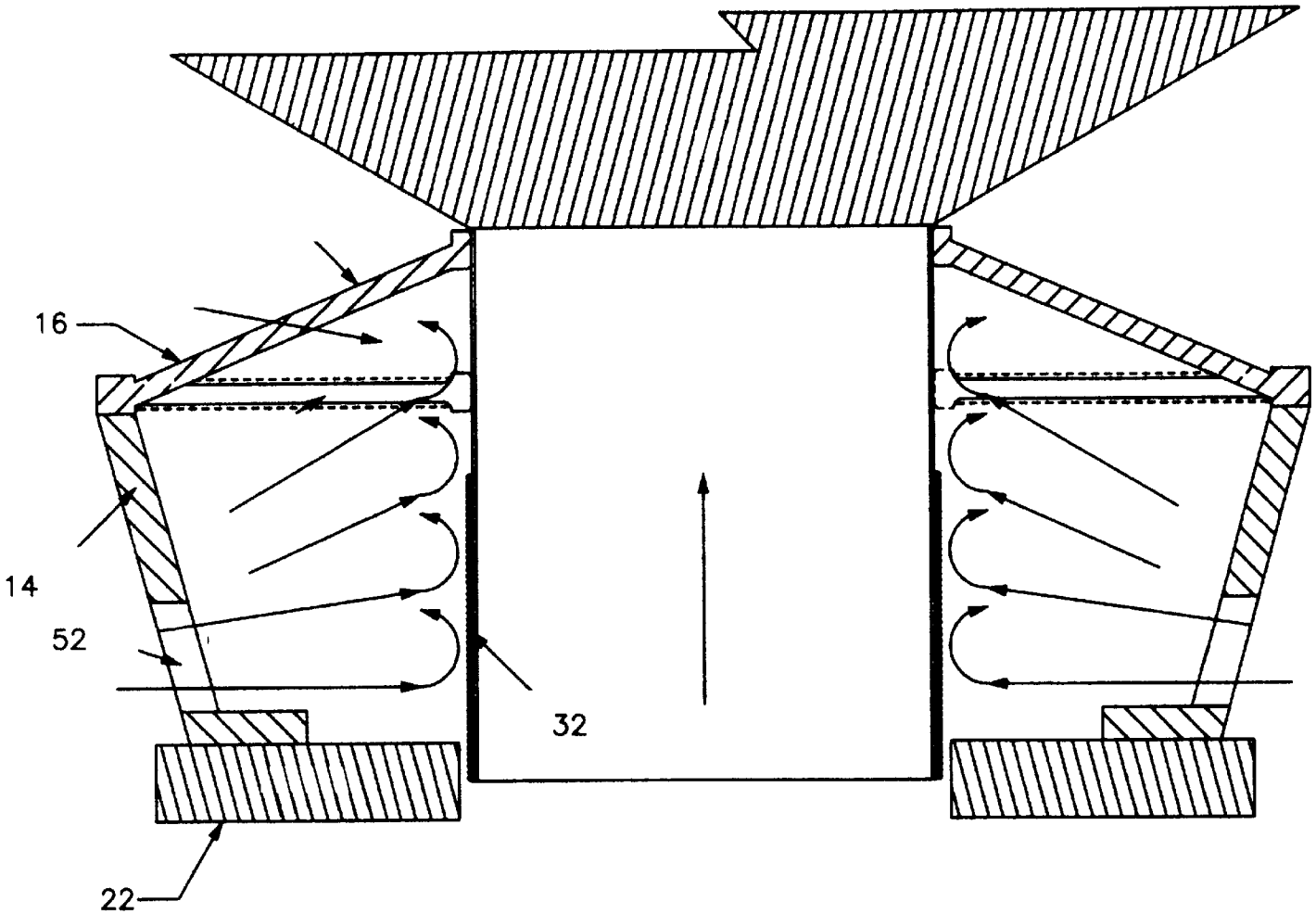
FIG. 4 is a cross sectional pictorial view depicting a positive excursion with flow patterns illustrated.

FIG. 4 further shows by illustration the use of the air pump on smaller speakers. In this embodiment, the vented frame 14 is coupled directly to the front plate 22. The vented frame 14 operates as both an intake for cooling air which is drawn across the voice coil during the positive excursion, and as an exhaust vent when the diaphragm 16 is placed into a negative excursion position. The use of an air impregnable diaphragm allows positive pumping of air thought the vent without lost of capacity found on porous spiders. A spider coated with a rubberized compound allows for the similar air pump action and is suitable for smaller speakers. However, use of a rubberized spider without increasing of the width fails to address the minimal adhesive surface and thus is not appropriate for high excursions.

Figure 5:
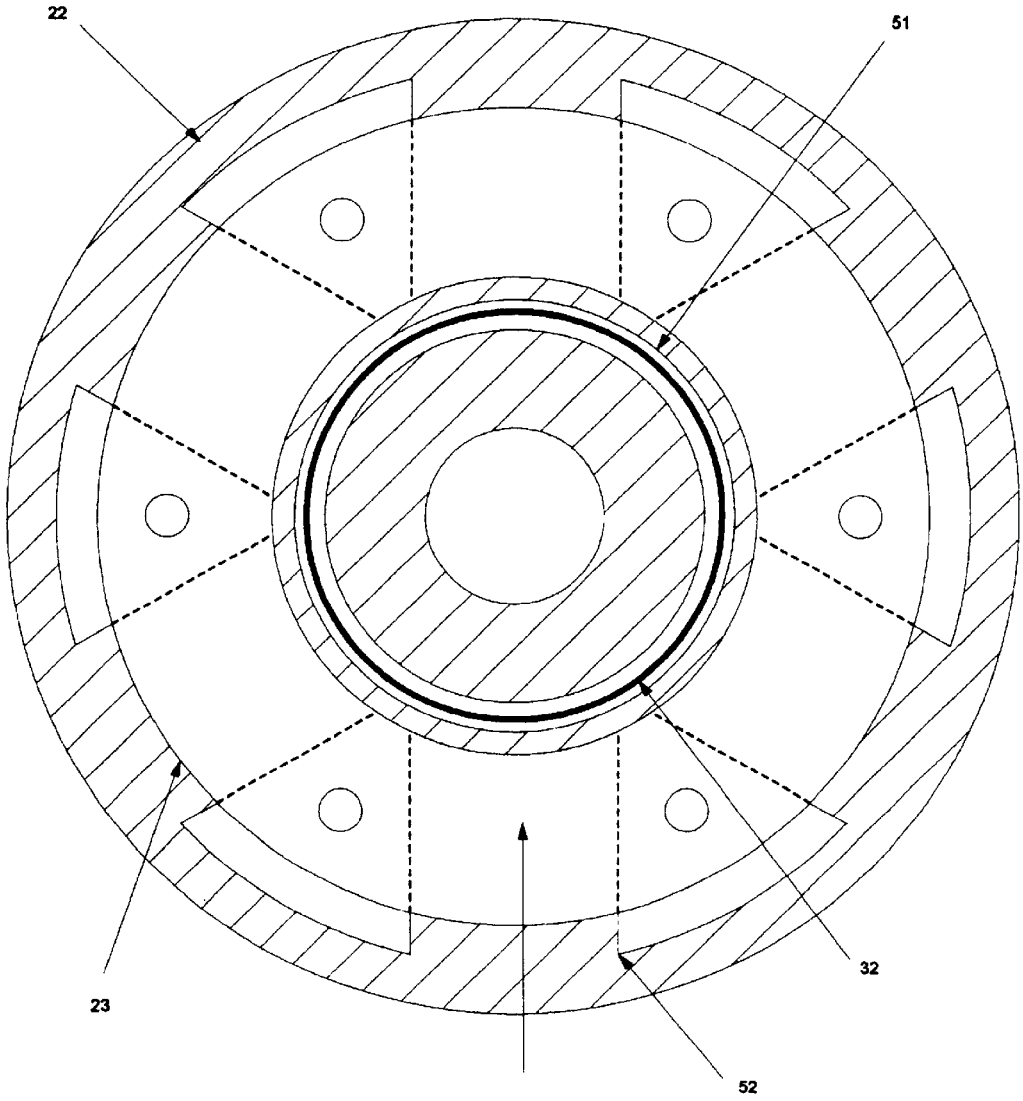
FIG. 5 is a top plane view of a radially disk with cut channels.

FIG. 5 is a top view of the front plate having the radially cut disk 23 with cut channels 52. The voice coil 32 is centrally positioned and sized to allow an air gap 51 between the voice coil 32 and the front plate 22. Use of a non-ferrous front plate eliminates any magnetic affect to the voice coil. The cut channels are sized so as to allows intake flow but inhibit exhaust. Further, the placement of the cut channels is strategically directed along the surface of the voice coil so as not to create an voice coil imbalance but assure proper air cooling. The front plate can have the cut channels formed integral therewith, or the cut channels can be formed in a separate disk and secured to the front plate.

Figure 6:
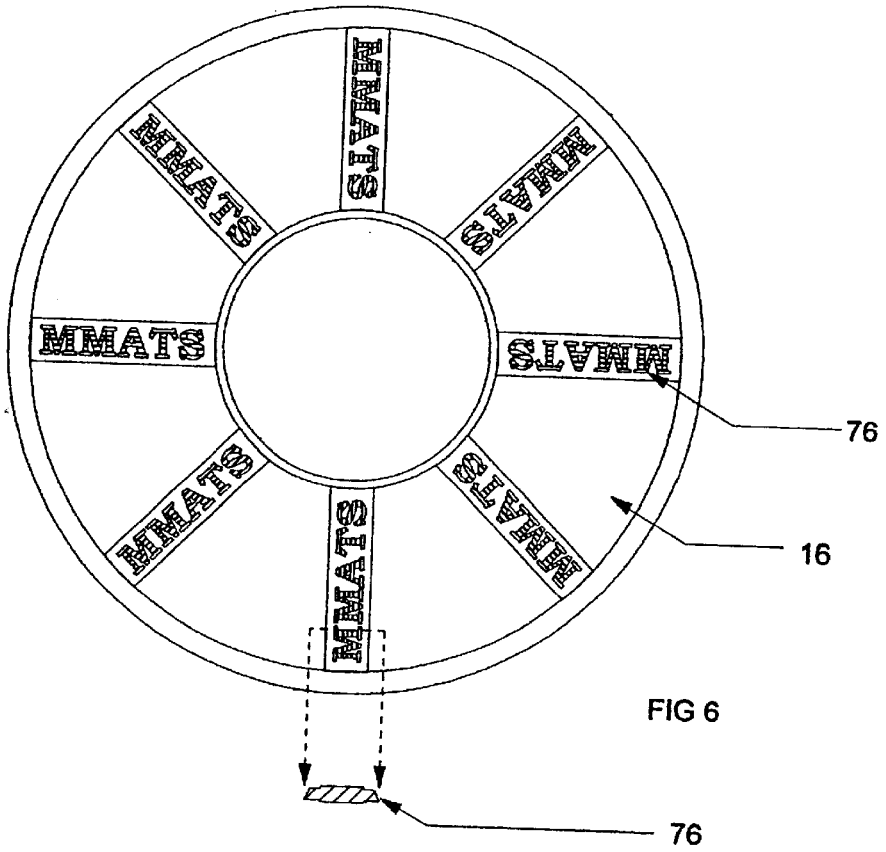
FIG. 6 is a top plane view of diaphragm.
Figure 7:
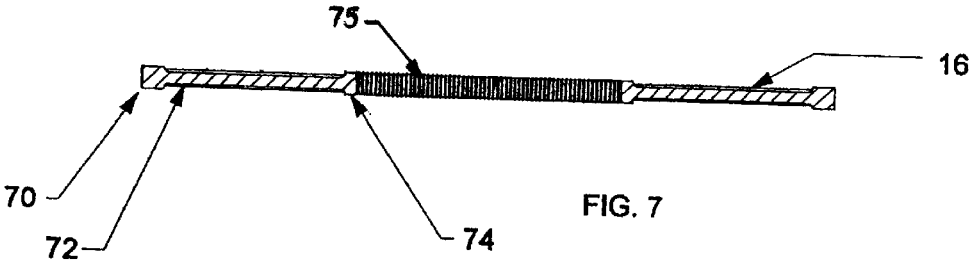
FIG. 7 is cross section side view of FIG. 6.

FIGS. 6 and 7 illustrate a top view and cross sectional views of the diaphragm 16. The embodiment depicted is for an eight inch spider with a three inch center cutout for mounting a three inch voice coil. The diaphragm employs reinforcement ribs 76, in lieu of additional thickness, to prevent the diaphragm from wobbling or otherwise causing the voice coil to contact the front plate during excursions. The diaphragm 16 has an enlarged end piece 70 that is thicker than the body 72 portion. The enlarged end piece 70 provides an enhanced area for adhesive attachment to the frame. Similarly, the inner piece 74 further provides an enhanced area for attachment to the voice coil. The inner piece 74 may include a serrated wall 75 to assist in the adhesive securement. As previously mentioned, the diaphragm can also be a conventional cloth spider that is coated with an air impregnable material such as SP 370 from C.P. Moyen. However, while the coating acts to provide the air pump, the thickness of the spider limits excursions due to the limited voice coil adhesive surface.

It is to be understood that while we have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. An air pump speaker comprising:

a support frame defined by a back plate, a front plate, and a speaker frame, said speaker frame having a lower end secured to said front plate and an upper end extending outwardly therefrom;

a motor assembly having a permanent magnet positioned between said back plate and said front plate, and a voice coil;

a cone coupled to said voice coil at a first end and coupled to said frame by a surround at a second end;

a diaphragm connected at an outer diameter to said upper end of said frame and at an inner diameter to said voice coil;

at least one intake vent constructed and arranged for taking in cool air proximate to said voice coil;

at least one unidirectional exhaust vent for exhausting air heated by said voice coil outwardly through said speaker frame;

wherein movement of said voice coil causes said diaphragm to draw air through said intake vent and exhaust said air through said exhaust vent for cooling of said voice coil.

2. The air pump speaker according to claim 1 wherein said diaphragm is rubber coated cloth.

3. The air pump speaker according to claim 1 wherein said diaphragm inner diameter includes a serrated surface.

4. The air pump speaker according to claim 3 wherein said diaphragm is a single piece of butyl rubber.

5. The air pump speaker according to claim 3 wherein said diaphragm is ribbed between said inner diameter and said outer diameter.

6. The air pump speaker according to claim 2 wherein said inner diameter has a first thickness and said outer diameter section has a second thickness.

7. The air pump speaker according to claim 6 wherein said first thickness and said second thickness are about equal.

8. The air pump speaker according to claim 1 wherein said intake vent includes at least one channel integrally formed within said front plate, said at least one channel constructed and arranged to direct air across a portion of said motor assembly.

9. The air pump speaker according to claim 8 wherein said front plate includes a plurality of integrally formed channels.

10. The air pump speaker according to claim 8 wherein said diaphragm is constructed of a gas impermeable material.

11. A method of unidirectionally cooling a front plate and motor assembly of a speaker, including a support frame defined by a back plate, a front plate, and a speaker frame, said speaker frame having a lower end secured to said front plate and an upper end extending outwardly therefrom, a motor assembly having a permanent magnet positioned between said back plate and said front plate, and a voice coil comprising:

providing an intake flow path between said front plate and said permanent magnet;

providing a unidirectional exhaust flow path within said speaker frame;

introducing air into said intake flow path in response to movement of said voice coil in a first direction so that said air is directed across said motor assembly and said voice coil, said air accumulating within said support frame;

exhausting said air from said support frame in response to movement of said voice coil in a second direction, said air exiting through said unidirectional exhaust flow path.

12. The method of unidirectionally cooling a front plate and motor assembly of a speaker according to claim 11 including a diaphragm, said diaphragm having at an outer diameter connected to said upper end of said frame and an inner diameter connected to said voice coil.

13. The method of unidirectionally cooling a front plate and motor assembly of a speaker according to claim 12, wherein said diaphragm is constructed of a rubber coated cloth.

14. The method of unidirectionally cooling a front plate and motor assembly of a speaker according to claim 12, wherein said diaphragm is constructed of a gas impermeable material.

15. The method of unidirectionally cooling a front plate and motor assembly of a speaker according to claim 14, wherein said gas impermeable material is butyl rubber.

16. The method of unidirectionally cooling a front plate and motor assembly of a speaker according to claim 15, wherein said diaphragm includes a plurality of ribs extending between said inner diameter and said outer diameter, wherein said ribs prevent said diaphragm from wobbling during operation of said speaker voice coil.

17. The method of unidirectionally cooling a front plate and motor assembly of a speaker according to claim 14, wherein said diaphragm inner diameter includes a plurality of integrally formed serrations for enhancing an adhesive connection between said diaphragm and said voice coil.

18. The method of unidirectionally cooling a front plate and motor assembly of a speaker according to claim 11, wherein said front plate includes at least one integrally formed channel, said channel constructed and arranged for intake flow of air in response to movement of said voice coil in a first direction so that said air is directed across said motor assembly and said voice coil.

19. The method of unidirectionally cooling a front plate and motor assembly of a speaker according to claim 11, wherein said exhaust path includes at least one aperture extending through said frame, said at least one aperture including a valve, said valve constructed and arranged for unidirectional air flow.

20. The method of unidirectionally cooling a front plate and motor assembly of a speaker according to claim 19, wherein said exhaust valve is a flapper valve.

* * * * *